United States Patent [19]

Valditerra

[11] Patent Number: 4,924,042

[45] Date of Patent: May 8, 1990

[54] RAILCAR FOR RENOVATING RAILWAYS

[75] Inventor: Enrico Valditerra, Viale Rimembranze 67, 15067 Novi Ligure, Province of Alessandria, Italy

[73] Assignee: Enrico Valditerra, Novi Ligure, Italy

[21] Appl. No.: 200,494

[22] Filed: May 31, 1988

[30] Foreign Application Priority Data

Jun. 8, 1987 [IT] Italy ..... 67486 A/87

[51] Int. Cl.[5] ..... E01B 29/06

[52] U.S. Cl. ..... 104/9; 104/2

[58] Field of Search ..... 104/9, 2, 10, 12, 7.1

[56] References Cited

U.S. PATENT DOCUMENTS

| | | | |
|---|---|---|---|
| 3,691,957 | 9/1972 | Plasser et al. | 104/9 |
| 3,913,490 | 10/1975 | Theurer et al. | 104/12 |
| 4,004,524 | 1/1977 | Scheuchzer et al. | 104/2 |
| 4,502,389 | 3/1985 | Theurer et al. | 104/12 X |
| 4,643,100 | 2/1987 | Valditerra | 104/2 |

FOREIGN PATENT DOCUMENTS

| | | | |
|---|---|---|---|
| 57128 | 8/1982 | European Pat. Off. | 104/9 |
| 1904126 | 5/1970 | Fed. Rep. of Germany | 104/9 |
| 2008174 | 9/1971 | Fed. Rep. of Germany | 104/12 |

*Primary Examiner*—Margaret A. Focarino

*Assistant Examiner*—Joseph D. Pape

*Attorney, Agent, or Firm*—Guido Modiano; Albert Josif

[57] ABSTRACT

The railcar includes: an operating unit provided with equipment for removing the old tracks and with supporting elements for advancing on the old sleepers stripped of their tracks, and, in sequence: first elements for gripping the old sleepers, capable of executing controlled cyclic oscillatory and vertical movements to grip the old sleepers, for removing them from their original seat and depositing them on a removal conveyor; a rotary operating element, capable of executing controlled cyclic oscillatory and vertical movements for the prearrangement of each seat stripped of its related old sleeper; at least one strike element, susceptible to longitudinal motion with respect to the frame of the operating unit and subject to fluid actuated control elements for the compaction of the new laying plane in each prepared seat; second grip elements, capable of executing controlled cyclic oscillatory and vertical movements for controllably resting them on the laying plane of each regenerated and compacted seat; and strike elements also capable of executing controlled longitudinal and vertical movements, for the packing of rubble for filling and final securing, fed into the spaces comprised between the walls of the regenerated seat and the new laid sleeper.

27 Claims, 4 Drawing Sheets

Fig. 5
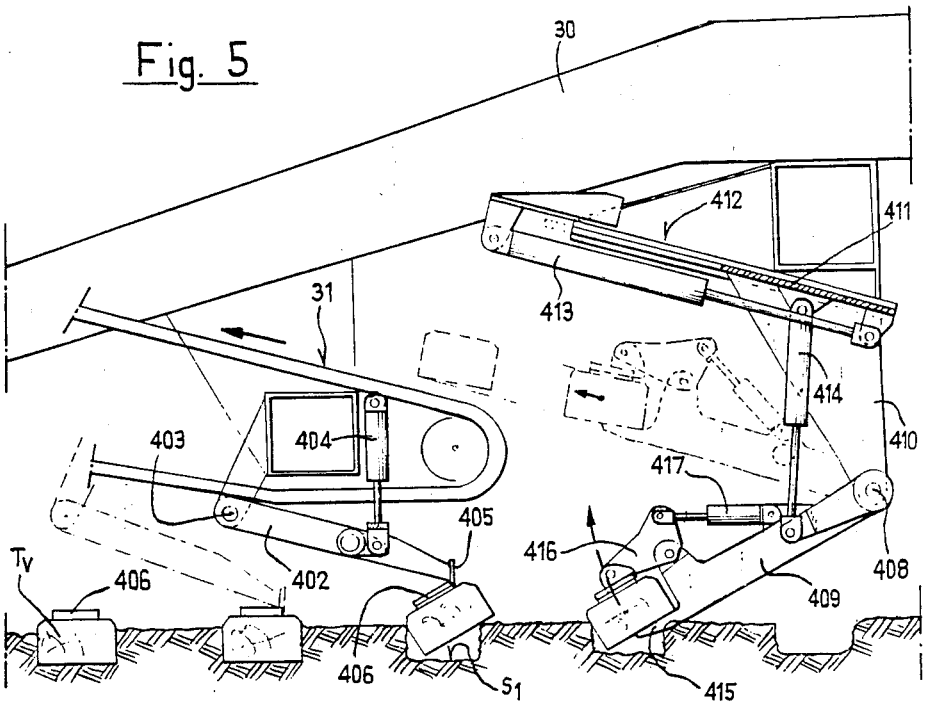
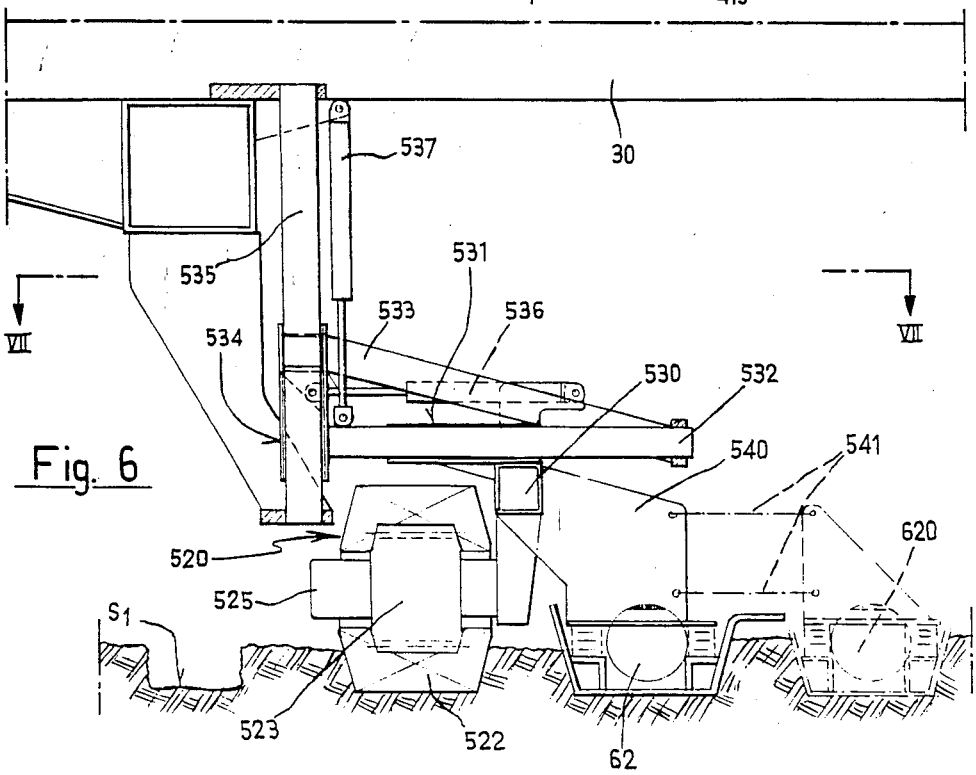
Fig. 6

RAILCAR FOR RENOVATING RAILWAYS

BACKGROUND OF THE INVENTION

The present invention relates to a railcar for renovating railways and more precisely to a railcar comprising an operating unit equipped for the execution, in sequence, of the following operative steps: removal of the old tracks, removal of the old track supporting sleepers, remaking of the laying plane of the new sleepers, laying of new sleepers; and wherein said operating unit is provided with supporting means to allow its advancement on the old sleepers already stripped of their tracks.

Railcars of the specified type have been hitherto produced, intended to operate continuously for the total renovation of the railway, i.e. for the total replacement of the old track supporting sleepers, the total remaking of their laying plane, the laying on said plane of new sleepers and the successive remaking of the ballast by means of the deposition of new rubble and/or of regenerated rubble in the spaces comprised between the new sleepers.

For this purpose, currently known renovation railcars are mostly equipped with means for removing the old sleepers capable of systematically removing them from the ballast and of depositing them on conveyors which transfer them to an accumulation area on board the railcar, with one or more plowshares for removing the displaced rubble and for levelling the laying plane and with elements, generally acting by gravity, for laying, regularly spaced, the new sleepers on the previously levelled laying plane.

With known railcars of the specified type it is therefore not possible to execute interventions for maintenance or revision entailing the partial and occasional replacement of the sleepers in the section involved, and on the other hand such partial interventions are often sufficient to restore the original efficiency and safety of the track with markedly lower costs.

The inadequacy of known railcars for partially renovating tracks essentially derives from the fact that the current systems for stripping the old sleepers are incapable of extracting them from their related original seats without damaging the laying plane of said seats, so that the laying of the new sleepers entails the complete remaking of said plane.

SUMMARY OF THE INVENTION

The aim of the present invention is to eliminate these disadvantages by providing a railcar capable of performing the total or partial renovation of railways, in particular the partial or occasional replacement of old sleepers with new sleepers having structural and geometrical characteristics similar to or different from the old ones, for example the partial replacement of old wood sleepers with new sleepers in concrete mix.

Within this aim, a particular object of the present invention is to provide a railcar for renovating railways, which is provided with means for the removal of the old sleepers capable of removing them without damaging the laying plane of the original containment seat.

Another particular object of the present invention is to provide a railcar for renovaing railways, which is provided with means adapted to regenerate the original seats of the old sleepers to allow the correct and levelled laying of the new ones and their locking by refilling with rubble.

In particular the regeneration of the original seats is aimed at preventing the new sleepers from being subjected, after laying and securing, to settlement or yieldings different from those of the old sleepers left in use, this allowing the correct longitudinal path of the regenerated track.

A further important object of the present invention is to provide a railcar the operating means whereof, though they perform partial replacement interventions as specified, allow the continuous advancement of the railcar, avoiding thereby idle wait times and delays due to the stopping decelerations and to the starting accelerations of the railcar itself.

This aim, and these objects and others which will become apparent from the following detailed description, are achieved by a railcar for renovating railways comprising an operating unit provided with equipment for removing the old tracks and with supporting elements for advancing on the old sleepers stripped of their tracks, characterized in that it comprises in sequence: first grip means, capable of executing controlled cyclic oscillatory and vertical movements for gripping the old sleepers, removing them from their original seat and laying them on a removal conveyor; a rotary operating element, capable of executing controlled cyclic oscillatory and vertical and horizontal movements for preparing each seat stripped of its related old sleeper; at least one strike element, susceptible to longitudinal and cyclic motion with respect to the frame of the operating unit and subject to fluid actuated displacing and loading means for compacting the new laying plane in each prepared seat and for shaping said seat; second grip means, capable of executing controlled cyclic oscillatory and vertical movements for gripping the new sleepers from a feeder conveyor and for controllably resting them on the laying plane of each new shaped and compacted seat, and strike means also capable of executing controlled longitudinal and vertical movements for packing rubble for filling and final securing, fed into the spaces comprised between the walls of the new seat and the new laid sleeper.

BRIEF DESCRIPTION OF THE DRAWINGS

Further characteristics and advantages of the present invention will become apparent from the following detailed description and with reference to the accompanying drawings, given only by way of non-limitative example, wherein:

FIG. 5 is a detailed elevation view showing the first grip means for the removal of the old sleepers, according to another aspect of the invention;

FIG. 6 is an elevation view showing a rotating operating element and a strike element combined into a single operating unit, according to still another aspect of the invention;

DESCRIPTION OF THE PREFERRED EMBODIMENTS

Figure 1:
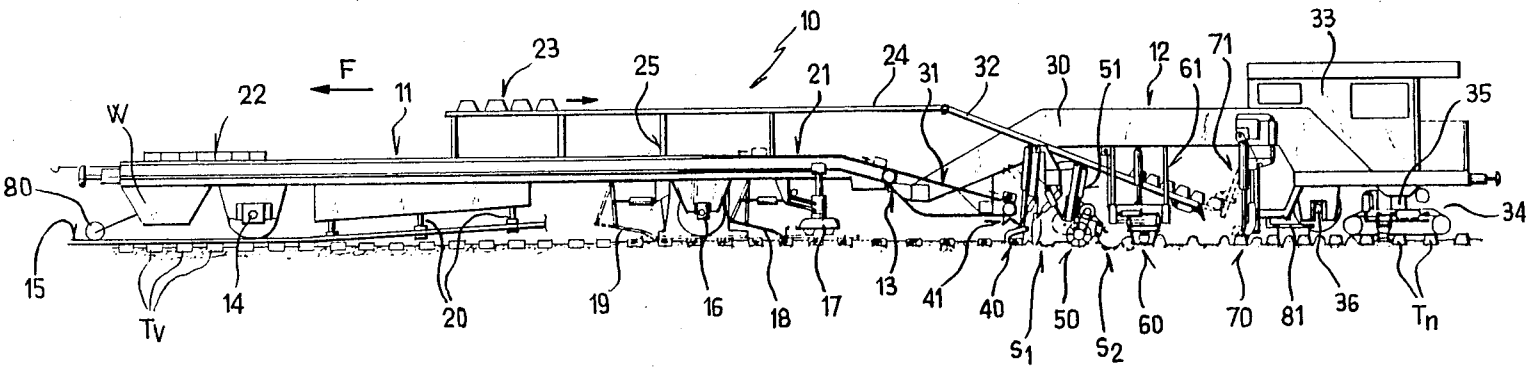
FIG. 1 is a lateral elevation view of the operating unit of a renovation railcar according to the present invention.

The railcar for renovating railways according to the invention comprises an operating unit 10 according to FIG. 1, intended to advance while operating, in the direction of the arrow F, and which is generally preceded by a certain number of storage rail cars (not illustrated) adapted to receive the old removed materials and to carry the new ones to be laid and which can be followed by other per se known operating units, for example for laying and bolting the new tracks.

The operating unit 10 comprises a carriage defined by a first 11 and by a second 12 frame, mutually connected in a per se known manner by means of a connecting articulation 13.

The frame 11 comprises a first axle 14 the wheels whereof rest on the old tracks 15, as yet not removed, and a second axle 16 cooperating with support means generally indicated at 17–18 and 19. Their structure and operating modes for guiding and advancing the carriage on the railway, already stripped of its old tracks, are described in detail in the U.S. Pat. No. 4,643,100 filed by this same Applicant.

It should be noted that the use of the support means 17-18-19, though advantageous, is not limitative for the present invention, since said means may be replaced with other known support means such as tracked shoes and the like.

Known roller clamps 20 are arranged between the axles 14 and 16, and are adapted to lift the tracks 15 to be removed off the old sleepers $T_v$; a power generator unit W is arranged ahead of the axle 14 and drives a central hydraulic unit and an electric generator.

Upwardly, the frame 11 bears a conveyor 21 leading to a magazine 22 for the old removed sleepers, and also bears a magazine 23 and a conveyor 24 of new sleepers to be laid and a portal conveyor 25 to move the materials between the magazines 22–23 and the storage railcars; the portal conveyor being movable on auxiliary tracks rigidly associated with the frame 11.

The frame 12 is constituted by strong side members 30 bearing a conveyor 31 for the removal of old sleepers linked to the conveyor 21, a conveyor 32 for new sleepers linked to the conveyor 24, an operating cabin 33, the operating system 40-50-60-70 according to the present invention and a supporting tracked shoe 34, raisable and lowerable by means of a hydraulic jack 35 to support the frame in the place of an axle 36 serving only for transfering the operating unit.

The operating system according to the invention comprises first grip means 41 for gripping the old sleepers $T_v$, for removing them from their original seat and depositing them on the removal conveyor 31, a rotating operating element 51 for prearranging each original seat $S_1$ stripped of its related old sleeper; at least one strike element 61 for compacting the new laying plane in each prearranged seat $S_2$ and forming new seats $S_3$, second grip means 71 for gripping and laying the new sleepers $T_n$ in the new seats $S_3$.

More particularly, said first grip means comprise two identical paired grip elements arranged on the two outer sides of the side members 30 and adapted to act separately at the opposite ends of each sleeper. Each grip element is formed by a wedge 42, slideable on a corresponding column 43 connected at the articulation 144 to the frame 12.

As is clearly shown in the figure, each wedge 42 is intended to be sunk into the ballast on the rear side of each sleeper to be removed and for this purpose it is controlled by a vertical movement jack 44. It should be observed that the wedges 42 just partially engage the rear surface of the sleepers, without affecting the old laying plane thereof; the sinking being adjusted so that the end of the wedge is always above the lower resting face of said sleeper. A grip jaw 45 cooperates with each wedge 42 and is articulated to the wedge and controlled by an actuator jack 46. A third jack 47 is arranged to produce the controlled oscillation of the column 43. The operating cycle of said first grip means is as follows: when, upon advancement of the railcar, the axis of the columns 43 is aligned with the rear face of the sleeper to be removed, the jacks 44 are actuated and cause the sinking of the wedges 42 in the manner described above. Once the sinking has occurred, the jacks 46 are activated to close the grip jaws 45 on the sleepers.

During these operative steps the advancement of the railcar is compensated by the free or controlled oscillation of the columns 43 about their own articulations 144 (anticlockwise with reference to the drawing). Once a preset oscillation angle has been reached, the jacks 44 are activated in the opposite direction and cause the lifting of the wedges 42 and of the sleeper which is thus removed from its own original seat $S_1$ and lifted to be arranged on the conveyor 31 by virtue of the activation of the jack 47, which causes the opposite (clockwise) oscillation of the columns 43, and by virtue of the opening of the grip jaws 45.

The rotating element 51 is arranged immediately downstream the grip means 41 with reference to the advancement motion of the railcar, and comprises a milling roller 52 arranged with its own axis transversely to the direction of advancement of the railcar and supported by a supporting plate 53 bearing a motor 54 for the actuation of the roller 52 by means of a transmission 55. The plate 53 is supported, with the possibility of vertical movements, on a pair of guiding and retention columns 56 connected at the articulation 57 to the frame 12. A jack 58 is provided to produce controlled vertical movements of the plate 53 and therefore of the milling roller 52 and jacks 59 are provided to produce the oscillation of the columns 56 about their own articulations 57.

Preferably, with the rotating element 51 there is associated a means for sorting rubble lifted out of the seat $S_1$ to be prepared and for depositing said rubble at the sides of the ballast.

Figure 3:
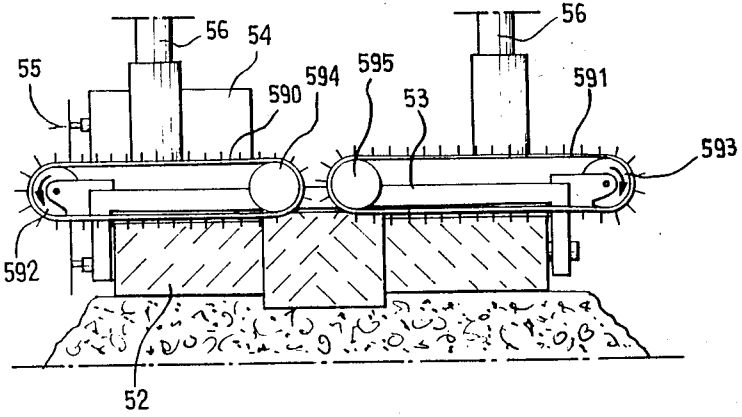
FIG. 3 is an enlarged scale cross section view taken along the line III—III of FIG. 2.

As shown in FIG. 3, the sorting means comprises two conveyor belts 590–591 extending, transversely to the direction of advancement of the railcar, respectively between a corresponding drive wheel 592–593 and a return wheel 594–595. The conveyors 590–591 may be actuated in opposite directions to deposit the rubble lifted by the roller 52 on the two sides of the ballast or in the same direction to deposit said rubble on one side or on the other.

The operation of the rotating element 51 is as follows: the columns 56 being inclined in the direction of advancement of the railcar, when the milling roller 52 is aligned with the seat $S_1$ to be prepared, it is lowered into said seat by means of the jack 58, the motor 54 having been activated. The roller prepares the seat by removing the excess rubble for a preset depth and by imparting to the prepared seat $S_2$ a channel-like profile; the removed rubble being accumulated partially to the sides of the ballast and partially on the rear and/or front side of each seat. Also in this case the continuous advancement of the railcar is compensated by the free or controlled oscillation of the columns 56 about their own articulations 57. Once a preset oscillation amplitude (corresponding to a preset work time of the roller 52) has been reached, the jacks 58 and 59 are activated in sequence and respectively cause the lifting of the roller out of the prepared seat $S_2$ and the reverse oscillation of the columns 56, which return to their initial position to start a new working cycle in the oncoming seat to be prepared.

The strike element 61, arranged immediately downstream the rotating element 51, is constituted by a vibrating mass 62 supported by a frame 64 by means of a counterframe 63. The vibrating mass 62 is capable of executing longitudinal horizontal movements (parallel to the direction of motion of the railcar) with respect to the frame 64 by means of retention and sliding guides (not illustrated) interposed between said counterframe and said frame. In turn the frame 64 is supported and guided by vertical uprights 65 with respect whereto it can perform vertical lifting and lowering movements. A jack 66 controls the horizontal movements of the counterframe 63 and a jack 67 controls the vertical movements of the frame 64, furthermore applying to the vibrating mass 62 the required vertical work load.

As is clearly shown in the figure, the vibrating mass 62 has a trapezoidal shape to impart to the new seat $S_3$ a caisson-like shape defined by a laying plane $P_p$ and by front shoulders $S_p$. A control means 68, for example constituted by a wire-wound potentiometer, is provided to check the sinking of the mass 62 and accordingly the preset level of the laying plane $P_p$.

The operation of the strike element is the following: the counterframe 63 being at the end stop position of work start, with respect to the frame 64 (to the left with reference to FIG. 2), and the frame 64 being raised, the mass 62 is aligned with an approached prepared seat $S_2$, due to the motion of the railcar, the jack 67 is activated and causes the lowering of the frame 64 and the working engagement of the vibrating mass in the seat $S_2$. The mass 62 is activated and shapes the seat, compacting and setting the laying plane $P_p$ to the preset level. During this operation the translatory motion of the railcar is compensated by the free or controlled horizontal motion of the counterframe 63 with respect to the frame 64, the excursion whereof is set with reference to the preset maximum work time for the mass 62. The mass 62 is stopped by the control means 68 when the level of the plane $P_p$ reaches the preset position. Once the mass 62 has stopped, the jack 67 and the jack 68 are activated in reverse to respectively lift the frame 64 and to return the counterframe 63 and the vibrating mass 62 to their initial position.

To reduce the work times in the described step of shaping of the new seat $S_3$ and of formation of the new laying plane $P_p$, the machine may be fitted with two strike elements 61 arranged one after the other with reference to the motion of the railcar and operating in series each for a time equal to half the overall required time.

The second means 71 for gripping and laying the new sleepers $T_n$ in the new seats $S_3$ are arranged downstream the strike element or elements 61 and are constituted by a pair of identical grip shoes 72 supported freely slideable on corresponding uprights 73 oscillably pivoted at 74 to the outer sides of the side members 30. Each shoe 72 is controlled by a corresponding vertical movement jack 75 and each upright 73 is subject to a jack 76 adapted to cause the oscillation of said upright to move it from a position of removal of the new sleepers $T_n$ from the conveyor 32 (drawn in broken lines in FIG. 2) to a position of laying of said sleepers in the new seats $S_3$ and vice versa.

Each shoe is provided with elements for gripping the sleepers constituted by a grip jaw 172 actuated by a jack 173. To allow the operation of the grip means 71 with an oscillating cycle, the end of the conveyor 32 is provided with a fold-down flap 77, actuated by a jack 78, on which there stops the first sleeper $T_{n1}$ of the series of sleepers fed by the conveyor 32.

Figure 2:
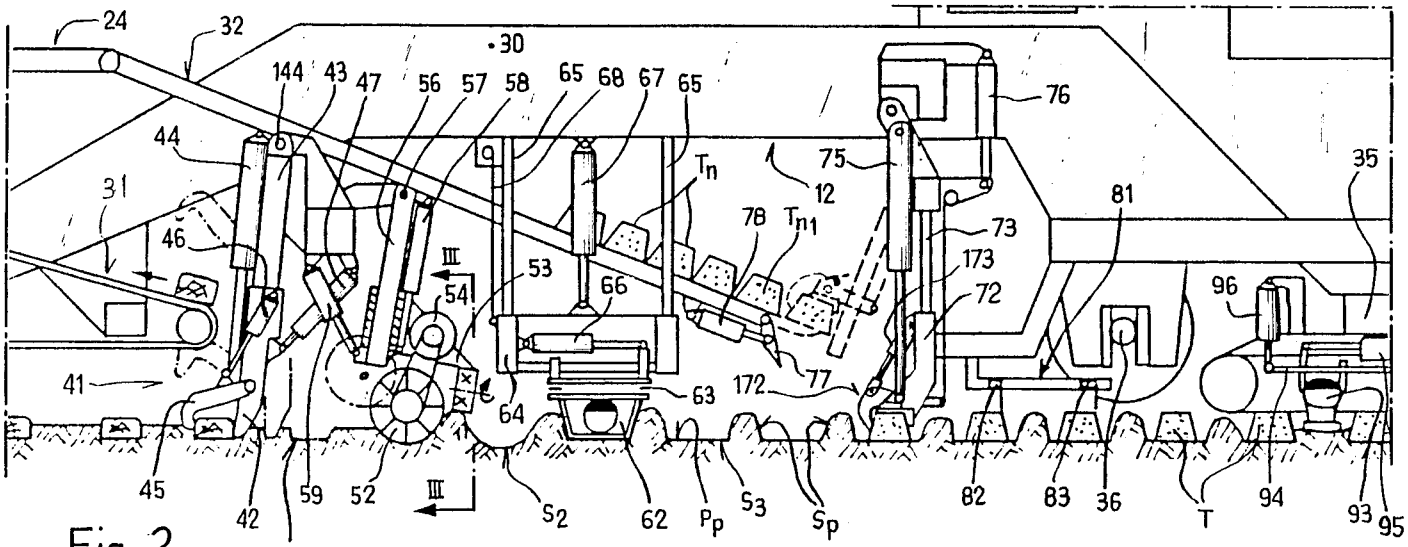
FIG. 2 is a detail view to an enlarged scale of FIG. 1.

The operation of the means 71 described above is as follows:

the uprights 73 being inclined as indicated in broken lines in FIG. 2, the jacks 75 are actuated to move the grip shoes 72 to engage the sleeper $T_n$ arranged on the flap 77. Subsequently the jacks 173 are activated to grip the sleepers, the jack 78 is activated to fold down the flap 77 and the jacks 76 are activated to cause the oscillation of the uprights 73, which arrange themselves vertically as illustrated in solid lines in FIG. 2. When, by virture of the advancement motion of the railcar, the new seat $S_3$ appears below the new sleeper suspended from the shoes 72, the jacks 75 are actuated and the shoes 72 are lowered to move the sleeper into said seat. The opening of the jaws 172, the separation of the sleeper from the shoes and its laying on the plane $P_p$ of the seat $S_3$ occur however only after the combined positive check of a pair of control means adapted to ensure the regular spacing of the successive sleepers. A first control means is constituted by a wheel 80, rigidly coupled to the frame 11 and rolling on the tracks 15. The wheel 80 is connected to a rotating potentiometer or to a pulse generator adapted to supply a control signal for laying the new sleeper when the railcar has travelled for a distance equal to the spacing pitch between one sleeper and the next. A second control means is constituted by a rod 81 rigidly coupled to the frame 12 and supporting a pair of sensors 82–83 (for example microswitches) separated by a distance equal to said spacing pitch and adapted to check said pitch by detection on a pair of previously existing sleepers or of previously laid new sleepers.

When the new sleeper is controllably laid as described above, the jaws 172 are opened, the shoes 72 are raised and the uprights 73 are moved angularly to the initial position for the extraction of a new sleeper.

Figure 4:
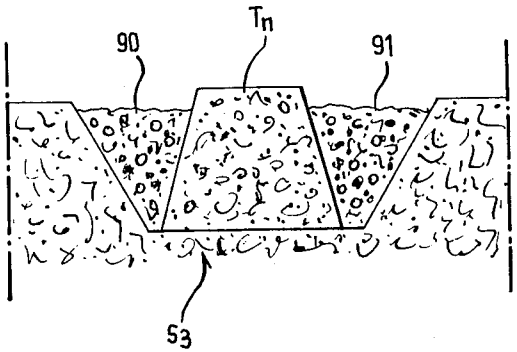
FIG. 4 is a schematic sectional view illustrating the terminal arrangement of the new sleepers in the respective new containment seats.

Once the laying has been performed, the new sleepers $T_n$ are secured in their respective caisson-like seats $S_3$ by means of the packing of rubble in the interspaces 90–91 indicated in FIG. 4. The packing rubble is at least partially constituted by new (or regenerated) material and at least partially constituted by the rubble extracted during the step of preparation of the original seats and accumulated behind and laterally to each prepared seat. This packing rubble is subject to compaction by a pair of vibrating masses 93 supported, with possibility of controlled longitudinal motions, by corresponding frames 94 arranged to the sides of the track-mounted supporting shoe 34.

The arrangement of the vibrating masses at the shoe 34 is particularly advantageous since the latter rests on the sleepers, preventing any unwanted movement thereof which may occur during compaction.

As described for the strike element 61, the frames 94 are also subject to jacks 95,96 respectively, for longitudinal movement and for vertical movement.

From the preceding description it is apparent that the railcar according to the present invention, in accordance with the stated aim and objects, allows the partial regeneration of railways, since the operating system 40-50-60-70 may be activated exclusively at the selected old sleepers to be replaced. Furthermore the actions of the rotating element 51 and of the strike element 61 may be adjusted so as to prepare a new laying plane $P_p$ at such a level as to allow the laying of new sleepers having a greater height than the old ones without varying the laying plane of the tracks, while the shoulders of old rubble which are left between two consecutive new seats ensure an effective retention of the new sleepers against the longitudinal movements of the track, allowing thereby a correct adjustment of the inner tensions on the tracks.

In the variated aspect of FIG. 5, the first means for gripping and removing the old sleepers $T_v$ are composed of a pair of operating elements acting separately and in succession. A first operating element is constituted by two paired oscillable arms 402 pivoted at pivot 403 on the sides of the frame of the operating unit. Each arm is controlled by a jack 404 and is provided with an end hook 405 capable of engaging with the track bolting plate 406, carried by the old sleepers $T_v$, when the jack 404 is actuated to lower the arm as indicated in broken lines in the figure. The engagement of the hooks 405 with the plates 406 and the advancement of the railcar cause the overturning of the old sleepers which are extracted from their original seat $S_1$ and left on the bank, in the inclined position illustrated in the figure, by virtue of the upward rotation of the arms 402 caused by the jacks 404 and the consequent disengagement of the hooks 405 from the plates 406.

In operative sequence with respect to the arms 402 there acts a second operating element for the grip and removal of the old sleepers $T_v$, also constituted by a pair of oscillable arms 409 pivoted at pivot 408 to the sides of corresponding wings 410 rigidly associated with a slider 411. The slider 411 is movable along longitudinal guides carried by an inclined plate 412 rigidly associated with the frame 30 of the unit and controlled by a double-action jack 413 adapted to move the slider with respect to the plate and therefore to the frame. A jack 414 is provided to produce the oscillation of each arm with respect to the wings 410 of the slider. The end of each arm is provided with a grip wedge 415 with which there cooperates a grip jaw 416 controlled by a jack 417.

The operation of this second operative element is as follows: the arms 409 being lowered as indicated in the figure, by virtue of the extension of the jacks 414, the wedges 415 meet and engage—as an effect of the advancement motion of the railcar—with the overturned sleepers abandoned by the hooks 405 of the first operating element 402. Then the jacks 414,417 are actuated in succession. The jacks 417 are adapted to close the grip jaws 416; the jacks 414 are adapted to raise the arms 409 moving them to the position illustrated in broken lines in the figure, in which said arms are parallel to the plate 412 in turn inclined so as to be parallel to the removal conveyor 31. At this point the jack 413 is energized and moves the slider 411 in the direction indicated by the arrow F in the figure, moving the wedge-like ends 415 of the arms 409 above the conveyor 31, and when the translatory motion is complete the jaws 415 are released to deposit said sleepers on said conveyor. The slider 411 is then moved in the reverse direction and the arms 409 are lowered to start a new grip cycle.

Figure 7:
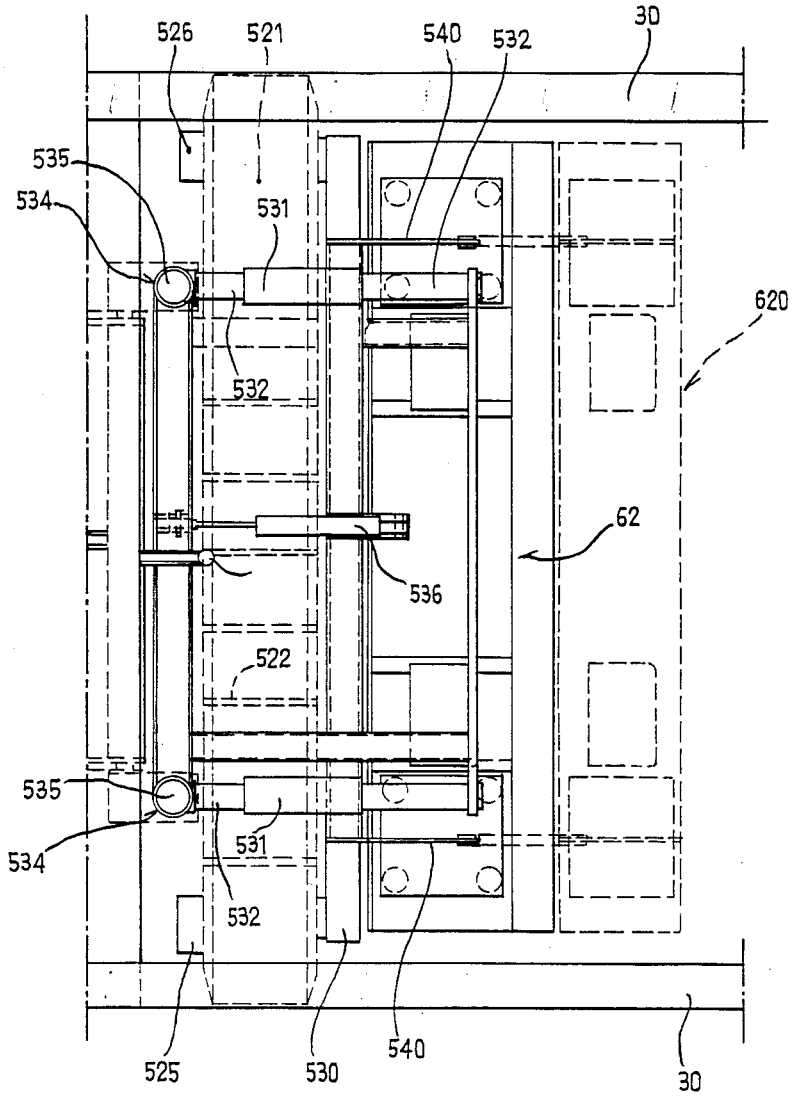
FIG. 7 is a sectional view taken along the line VII—VII of FIG. 6.

In the variated aspect of FIGS. 6 and 7, the rotating operating element 520 is constituted by a track 521 provided with profiled scarifying blades 522 and extending transversely with respect to the direction of advancement of the railcar between two pinions 523 keyed on corresponding shafts 525–526 one whereof is a driving shaft (of the two pinions, only pinion 523 is shown in FIG. 6, the top plan view of FIG. 7 showing the two respective shafts 526 and 525). The track and the related motor and transmission pinions are supported by a movable frame 530 provided with horizontal sleeves 531 fitted, freely slideable, on corresponding cylindrical supports 532 with horizontal axis. The supports 532 are in turn rigidly associated with a frame 533 provided with vertical sleeves 534 fitted, freely slideable, on guiding and retention columns 535 rigidly associated with the frame 12 of the railcar. A double-action jack 536 controls the horizontal movements of the frame 530 with reference to the supports 532 and a jack 537 controls the movements of the frame 533 with reference to the columns 535. According to this variated aspect, the translatory motion of the railcar is thus compensated—so as to allow the track 521 to prepare the seat $S_1$—by the horizontal free or controlled motion of the frame 530 and this allows to also associate with the frame 530 the strike element 61 to form a single operating unit. For this purpose the frame 530 is provided with strong ledges 540 for the support of a first vibrating mass 62 and possibly of a second vibrating mass acting in series to the first as previously mentioned; the second mass, if provided, being connected to the ledges 540 by means of articulating connecting rods 541.

The advantages of the arrangement described above with reference to FIG. 6 reside, as well as in the fact that the rotating element and the strike element are combined into a single operating unit, in the fact that one may impart to the scarifying blades 522 of the track 521 any profile and in particular the trapezoidal caisson-like profile of the seats $S_3$ similar to that of the vibrating masses 62.

Figure 8:
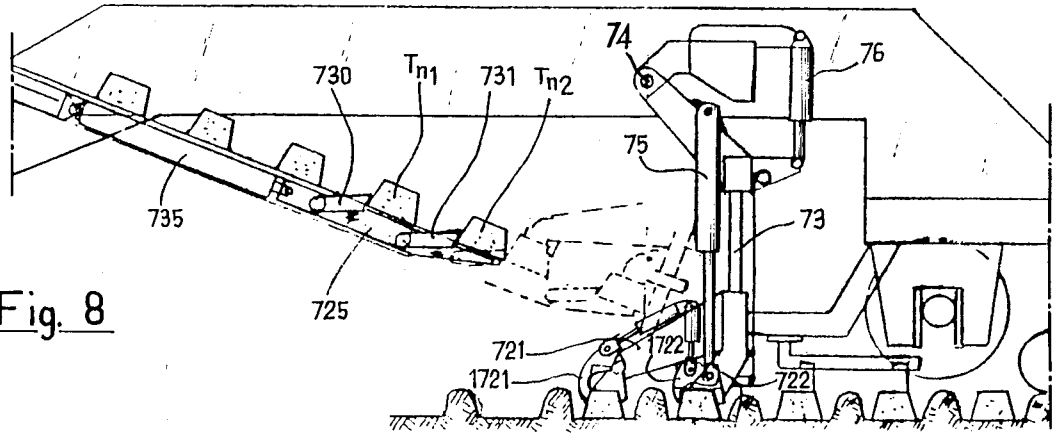
FIG. 8 is an elevation view showing second grip means for laying the new sleepers, according to a further aspect of the invention.

In the variated aspect of FIG. 8, adapted to an operating unit provided with two strike elements 61 paired in series, an advantageous embodiment of the second grip means 71 is illustrated. According to this variated aspect, each upright 730 is provided with two shoes 721–722 paired longitudinally and rigidly spaced by a distance equal to the spacing pitch between two consecutive sleepers. The shoes 721–722—provided with respective grip jaws 1721–1722—act simultaneously for gripping and laying pairs of sleepers $T_{n1}$–$T_{n2}$ which are positioned beforehand on a loader 725 provided at the end of the conveyor 32. The loader 725 is provided with elastically yielding stop pawls 730–731 adapted to space by one pitch unit the sleepers $T_{n1}$–$T_{n2}$ of each pair and is slideable on a supporting frame to pass from a position of reception of the sleepers, drawn in solid lines in the figure, to one of distribution, drawn in broken lines, wherein each pair of sleepers is aligned with the respective grip shoes 721–722. A jack 735 controls the movements of the loader from the first to the second position and vice versa.

The railcar thus conceived is susceptible to numerous modifications and variations, all within the scope of the inventive concept; furthermore all the details may be replaced with technical equivalent elements.

In practice the materials employed, as well as the dimensions, may be any according to the requirements and the state of the art.

I claim:

1. Railcar for renovating railways, comprising an operating unit provided with equipment for removing old tracks lying on old sleepers and with supporting means for advancing on said old sleepers deprived of said old tracks, each of said old sleepers lying in an old seat, said railcar having a frame for said operating unit and being adapted to have a forward motion, said railcar further comprising, in sequence:

(a) first grip means adapted to move with controlled cyclic oscillatory and vertical movements for gripping each of said old sleepers, for removing each of said old sleepers from a respective said old seat and for laying each of said old sleepers on a removal conveyor;

(b) a rotary operating element adapted to move with controlled cyclic oscillatory, vertical and horizontal movements for preparing each of said old seats, deprived of a respective said old sleeper, to define a prepared seat for each of said old seat;

(c) at least one strike element adapted to move cyclically with a longitudinal motion, relatively to said frame of said operating unit, and controlled by displacing and unloading fluid-actuated means for compacting each of said prepared seats to define a laying plane and for shaping each of said prepared seats to define a new seat, said new seat having compacted walls;

(d) second grip means adapted to move with controlled cyclic oscillatory and vertical movements for gripping new sleepers from a feeder conveyor and for laying each of said new sleepers on a respective said laying plane in a respective said new seat, interspaces being defined between said new sleepers and said compacted walls of said new seat;

(e) strike means adapted to move with controlled longitudinal and vertical movements for packing rubble into said interspaces for filling said interspaces to secure each of said new sleepers into a respective said new seat.

2. Railcar, according to claim 1, wherein said first grip means comprises two identical paired grip elements, said frame of said railcar having side members, said side members defining outer sides, said grip elements being arranged on said outer sides.

3. Railcar, according to claim 2, wherein said frame comprises a substantially vertical supporting column oscillably articulated therein, said paired grip elements comprising a wedge and a grip jaw, said grip jaw being articulated to said wedge and said wedge being axially slideable on said column, fluid actuated means being provided to move said wedge on said column, to oscillate said column on said frame and to open and close said grip jaw.

4. Railcar, according to claim 1, wherein said first grip means comprises a pair of operating elements acting separately and in succession.

5. Railcar, according to claim 1, wherein said old sleepers have bolting plates for said old tracks, said first grip means comprising a first operating element and a second operating element acting separately and in succession, said first operating element comprising two paired oscillable arms, jacks being provided to control said arms for vertical movements, said arms being provided with end hooks, said hooks being adapted to engage said bolting plates to overturn and extract each of said old sleepers from said respective old seat when said railcar moves forward.

6. Railcar, according to claim 1, wherein said old sleepers have bolting plates for said old tracks, said first grip means comprising a first operating element and a second operating element acting separately and in succession, said first operating element being adapted to extract and overturn each of said old sleepers, said second operating element comprising two paired oscillable arms, said arms being supported by a slider movable longitudinally on said railcar, said arms having ends, each of said ends having a grip wedge and a grip jaw, said wedge cooperating with said grip jaw in order to, in succession, grip said sleeper overturned by said first operating element, raise said sleeper, lay said sleeper on said removal conveyor; fluid actuated means being provided to operate said slider, said arms and said grip jaws.

7. Railcar, according to claim 1, wherein said rotary operating element is arranged immediatly downstream said first grip means, said rotary operating element comprising a milling roller, said milling roller having an axis, said axis being transverse to the direction of said forward motion of said railcar, said roller being adapted to remove rubble and to produce excess rubble.

8. Railcar, according to claim 7, wherein it comprises retention columns and means for sorting and unloading said excess rubble, said retention columns being articulated to said frame of said railcar, said milling roller being supported by a supporting plate, said supporting plate having a motor, said motor being adapted to actuate said roller and said means for sorting and unloading said excess rubble, said plate being supported on said retention columns for a vertical motion therein, fluid actuated means being provided to operate said plate for said vertical motion and to oscillate said columns articulated to said frame.

9. Railcar, according to claim 7, wherein it comprises retention columns and means for sorting and unloading said excess rubble, said retention columns being articulated to said frame of said railcar, said milling roller being supported by a supporting plate, said supporting plate having a motor, said motor being adapted to actuate said roller and said means for sorting and unloading said excess rubble, said plate being supported on said retention columns for a vertical motion therein, fluid actuated means being provided to operate said plate for said vertical motion and to oscillate said columns articulated to said frame, said means for sorting and unloading said excess rubble comprising a pair of conveyor belts, said conveyor belts extending transversely to the direction of said forward motion of said railcar.

10. Railcar, according to claim 1, wherein said rotary operating element comprises a track extending transversely to the direction of said forward motion of said railcar, said track having scarifying blades and being supported and operated by two pinions, said pinions being supported on respective shafts, one of said shafts being a driving shaft, said track and said shafts being supported by a supporting frame, said supporting frame having a vertical motion and an horizontal motion parallel to said forward motion of said railcar, fluid actuated means being provided to operate said supporting frame for said vertical and horizontal motions.

11. Railcar, according to claim 10, wherein said supporting frame of said track comprises a pair of horizontal sleeves, said horizontal sleeves being slideable on horizontal supports, said horizontal supports being associated with vertical sleeves, said vertical sleeves being slideable on vertical guide columns, said vertical guide columns being associated with said railcar frame.

12. Railcar, according to claim 1, wherein said strike element is arranged immediatly downstream to said rotary operating element, said strike element comprising a strike element frame supported on guide uprights associated with said railcar frame, said strike element frame having a vertical motion on said uprights, a counterframe being associated to said strike element frame by means of longitudinal guides for a longitudinal motion of said counterframe, said counterframe supporting at least one vibrating mass, fluid actuated means being provided to operate said strike element frame and said counterframe.

13. Railcar, according to claim 12, wherein said fluid actuated means comprises a jack, said jack being adapted to provide a required work load to said strike element frame and vibrating mass.

14. Railcar, according to claim 12, wherein said vibrating mass has a trapeizodal shape, said mass being adapted to impart a caisson-like shape to said new seat.

15. Railcar, according to claim 12, wherein said vibrating mass is adapted to move vertically with a selected sinking, said strike element comprising a control means for controlling said sinking of said vibrating mass, said control means comprising a wire-wound potentiometer, said potentiometer being adapted to detect said vertical motion of said strike element frame.

16. Railcar, according to claim 1, wherein it comprises two strike elements, said compacting of each of said prepared seats requiring an overall work time, said strike elements operating in series, each of said strike elements operating for a work time, said work time of each of said strike element being substantially half of the required overall work time.

17. Railcar, according to claim 10, wherein said at least one strike element and said track form a single unit, said strike element being associated with said supporting frame of said track.

18. Railcar, according to claim 10, wherein said at least one strike element and said track form a single unit, said strike element being supported by ledges, said ledges being associated with said supporting frame of said track.

19. Railcar, according to claim 1, wherein said second grip means are arranged downstream of said strike element and comprises at least two identical grip shoes, said grip shoes being supported by uprights and being slideable thereon, said uprights being pivoted to said railcar frame for an oscillation thereon.

20. Railcar, according to claim 19, wherein it comprises fluid actuated means for sliding said grip shoes on said uprights and for controlling said oscillation of said uprights on said frame.

21. Railcar, according to claim 19, wherein each of said grip shoes comprises sleeper grip jaws.

22. Railcar, according to claim 19, wherein it comprises a fold-down flap provided at said feeder conveyor, said second grip means operating with an oscillating cycle with said fold-down flap.

23. Railcar, according to claim 19, wherein said new sleepers are to be arranged at a distance, said second grip means comprising two pairs of said grip shoes, each of said uprights supporting one of said pair of grip shoes, said grip shoes of each of said pair being spaced by a distance equal to said distance between said sleepers.

24. Railcar, according to claim 19, wherein said new sleepers are to be arranged at a distance, said second grip means comprising two pairs of said grip shoes, each of said uprights supporting one of said pair of grip shoes, said grip shoes of each of said pair being spaced by a distance equal to said distance between said sleepers, said second grip means further comprising a supporting frame supporting a loader sliding thereon, said loader being provided at said feeder conveyor and having sleeper spacing pawls, each of said pairs of grip shoes cooperating with said loader, said loader being adpted to slide from a sleeper gripping position at said feeder conveyor to a sleeper dispensing position, fluid actuated means being provided to operate said loader.

25. Railcar, according to claim 1, wherein said second grip means cooperate with first and second control elements, said control elements providing a control signal adapted to control said grip means for laying a second new sleeper at a selected distance from an already layed first new sleeper.

26. Railcar, according to claim 25, wherein said first control elements comprise a wheel, said wheel being adapted to roll over said old tracks, saisd wheel being connected to a means for generating electric signals, said second control elements comprising a rod, said rod being associated with said railcar frame and supporting two sensors, said sensors being spaced of a distance which is equal to said selected distance, said selected distance being determined by said sensors by measuring the distance between two of said old sleepers.

27. Railcar, according to claim 1, wherein it comprises a track-mounted supporting carriage at the end of said operating unit, said carriage having a supporting frame moving vertically thereon, said supporting frame supporting said strike means, said strike means comprising a pair of vibrating masses moving longitudinally on said supporting frame, fluid actuated means being provided to operate said supporting frame and said vibrating masses for respective vertical and horizontal motions.

* * * * *